US005889429A

United States Patent [19]

Kobayashi et al.

[11] Patent Number: 5,889,429

[45] **Date of Patent: *Mar. 30, 1999**

[54] SEMICONDUCTOR INTEGRATED CIRCUIT AND SEMICONDUCTOR INTEGRATED CIRCUIT DEVICE

[75] Inventors: Souichi Kobayashi; Toshio Kishi, both of Tokyo, Japan

[73] Assignee: Mitsubishi Denki Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 660,865

[22] Filed: Jun. 10, 1996

[30] Foreign Application Priority Data

Jan. 22, 1996 [JP] Japan ..... 8-008392

[51] Int. Cl.[6] ..... G05F 1/10

[52] U.S. Cl. ..... 327/540; 327/102; 327/541; 327/545

[58] Field of Search ..... 327/102, 538, 327/543, 545, 546, 540, 541

[56] References Cited

U.S. PATENT DOCUMENTS

| | | | |
|---|---|---|---|
| 4,862,015 | 8/1989 | Grandfield | 327/101 |
| 5,442,314 | 8/1995 | Hara | 327/102 |
| 5,473,283 | 12/1995 | Luich | 327/157 |
| 5,504,459 | 4/1996 | Gersbach et al. | 327/156 |
| 5,532,636 | 7/1996 | Mar et al. | 327/157 |
| 5,631,585 | 5/1997 | Kinoshita et al. | 327/102 |
| 5,646,563 | 7/1997 | Kuo | 327/157 |

FOREIGN PATENT DOCUMENTS

| | | | |
|---|---|---|---|
| 60-111528 | 6/1985 | Japan . | |
| 4-112312 | 4/1992 | Japan . | |
| 4-263511 | 9/1992 | Japan | 327/102 |
| 58-171842 | 10/1993 | Japan . | |

OTHER PUBLICATIONS

K. Ueda et al., "A 16b Low–Power–Consumption Digital Signal Processor," 1993 IEEE ISSCC Digests of Technical Papers, pp. 28–29.

H. Suzuki et al., "A 0.75–V, 0.75MHz CMOS 32–bit RISC Microprocessor for portable applications," 1995 IEEE CICC Digests, pp. 573–574.

*Primary Examiner*—Terry D. Cunningham

*Attorney, Agent, or Firm*—Burns, Doane, Swecker & Mathis, LLP

[57] ABSTRACT

A semiconductor integrated circuit which converts power-supply voltage applied from outside into optimum voltage for operating an internal circuit at the frequency of an internal clock in response to a multiplication control signal supplied to a PLL circuit from outside to generate the internal clock for operating the internal circuit by dividing a clock supplied from outside or by judging the cycle of an internal clock generated by dividing an external clock so as to supply the optimum voltage to the internal circuit.

6 Claims, 12 Drawing Sheets

SEMICONDUCTOR INTEGRATED CIRCUIT AND SEMICONDUCTOR INTEGRATED CIRCUIT DEVICE

BACKGROUND OF THE INVENTION

1. Field of the Invention

The present invention relates to reduction in electric power consumption of a semiconductor integrated circuit and a semiconductor integrated circuit device.

2. Description of the Related Art

Electric power consumption P to be consumed by an LSI (Large Scale Integrated Circuit), such as a microprocessor and a DSP (Digital Signal Processor), of a type which is operated in response to an input clock is expressed by the following equation:

$$P=f\cdot C\cdot V^2$$

where f is the frequency of an internal clock, C is an effective capacity of the LSI and V is power-supply voltage.

Since the electric power consumption is in proportion to the frequency of the clock as can be understood from the foregoing equation, there have been LSIs of a type having a mode for interrupting the internal clock so as to reduce electric power consumption by interrupting the internal clock in a case where the operation of the LSI is not required. However, since interruption of the internal clock is interruption of the operation of the LSI, the foregoing method cannot reduce the electric power consumption of the LSI which is being operated.

Since the electric power consumption is in proportion to the square of the power-supply voltage, there have been LSIs of a type arranged to lower the level of internal power-supply voltage when the LSI is operated in order to reduce the electric power consumption.

However, if the level of the power-supply voltage is lowered, gate delay time in the LSI is elongated and, therefore, there arises a difficulty when the foregoing structure is applied to LSIs of a type which is operated at high speed.

As described above, the LSI involves elongation of the internal gate delay time when the internal power-supply voltage is lowered, thus resulting in the frequency, at which the LSI can be operated, being lowered. Thus, there arises a problem in that the level of the power-supply voltage for the LSI cannot easily be lowered to reduce electric power consumption. FIG. 12 is a so-called Shmoo Plot graph showing the relationship between the frequencies of a clock and power-supply voltages at which the LSI can be operated. The longer the cycle of the clock is, the lower the power-supply voltage, at which the LSI can be operated, becomes. The shorter the cycle of the clock is, the higher the power-supply voltage, at which the LSI can be operated, becomes.

To solve the foregoing problem, an integrated circuit device has been suggested which comprises a frequency detection circuit for detecting the frequency of the clock, a constant-voltage power-supply circuit for generating a plurality of constant voltages, and a power-source selection circuit for selecting the output from the constant-voltage power-supply circuit in accordance with an output from the frequency detection circuit (refer to Japanese Patent Application Laid-Open No. 58-171842).

Moreover, an electric circuit has been suggested (refer to Japanese Patent Application Laid-Open No. 4-112312) which comprises operating clock selection and generation means for selecting and switching frequencies of a plurality of operation clocks, a variable voltage power source and control means for controlling the level of the output voltage from the variable voltage power source in accordance with the frequency of the operation clock. An integrated circuit device has been suggested (refer to Japanese Patent Application Laid-Open No. 60-111528) which comprises a ring oscillation circuit for detecting delay time taking place in transmitting the signal and a comparison means for subjecting the oscillation cycle of the ring oscillation circuit and a reference value to a comparison to control the delay time taking place in transmitting the signal in accordance with an output from the comparison means.

SUMMARY OF THE INVENTION

In view of the foregoing, an object of the present invention is to provide a semiconductor integrated circuit and a semiconductor integrated circuit device capable of operating at optimum power-supply voltage corresponding to the clock frequency.

Another object of the present invention is to provide a semiconductor integrated circuit for converting external power-supply voltage into optimum voltage corresponding to the frequency of an internal clock in response to a multiplication control signal for dividing an external clock to generate an internal clock for operating an internal circuit or by judging the cycle of the internal clock generated by dividing the external clock so as to supply the optimum voltage to the internal circuit.

Another object of the present invention is to provide a semiconductor integrated circuit and a semiconductor integrated circuit device for converting power-supply voltage supplied from outside into optimum voltage for operating an internal circuit in accordance with degree of dispersion of the cycle of an internal clock to be generated so as to be supplied to the internal circuit from a standard cycle, that is, degree of signal transmission speed.

Another object of the present invention is to provide a semiconductor integrated circuit device having a terminal for supplying, to a semiconductor integrated circuit, signal voltage corresponding to a result of evaluation of dispersion of the cycle of an internal clock performed in a wafer state where a chip of the semiconductor integrated circuit has not been diced from a standard cycle, that is, a result of evaluation of dispersion in a signal transmission speed so as to convert power-supply voltage into voltage corresponding to the dispersion and supply the voltage to the internal circuit.

That is, another object of the present invention is to provide a semiconductor integrated circuit and a semiconductor integrated circuit device arranged to convert voltage to be supplied to the integrated circuit to a somewhat higher level in a case where the signal transmission speed is somewhat low and convert the voltage to be supplied to a somewhat lower level in a case where the signal transmission speed is somewhat high.

The above and further objects and features of the invention will more fully be apparent from the following detailed description with accompanying drawings.

DETAILED DESCRIPTION OF THE PREFERRED EMBODIMENTS

[Embodiment 1]

Figure 1:
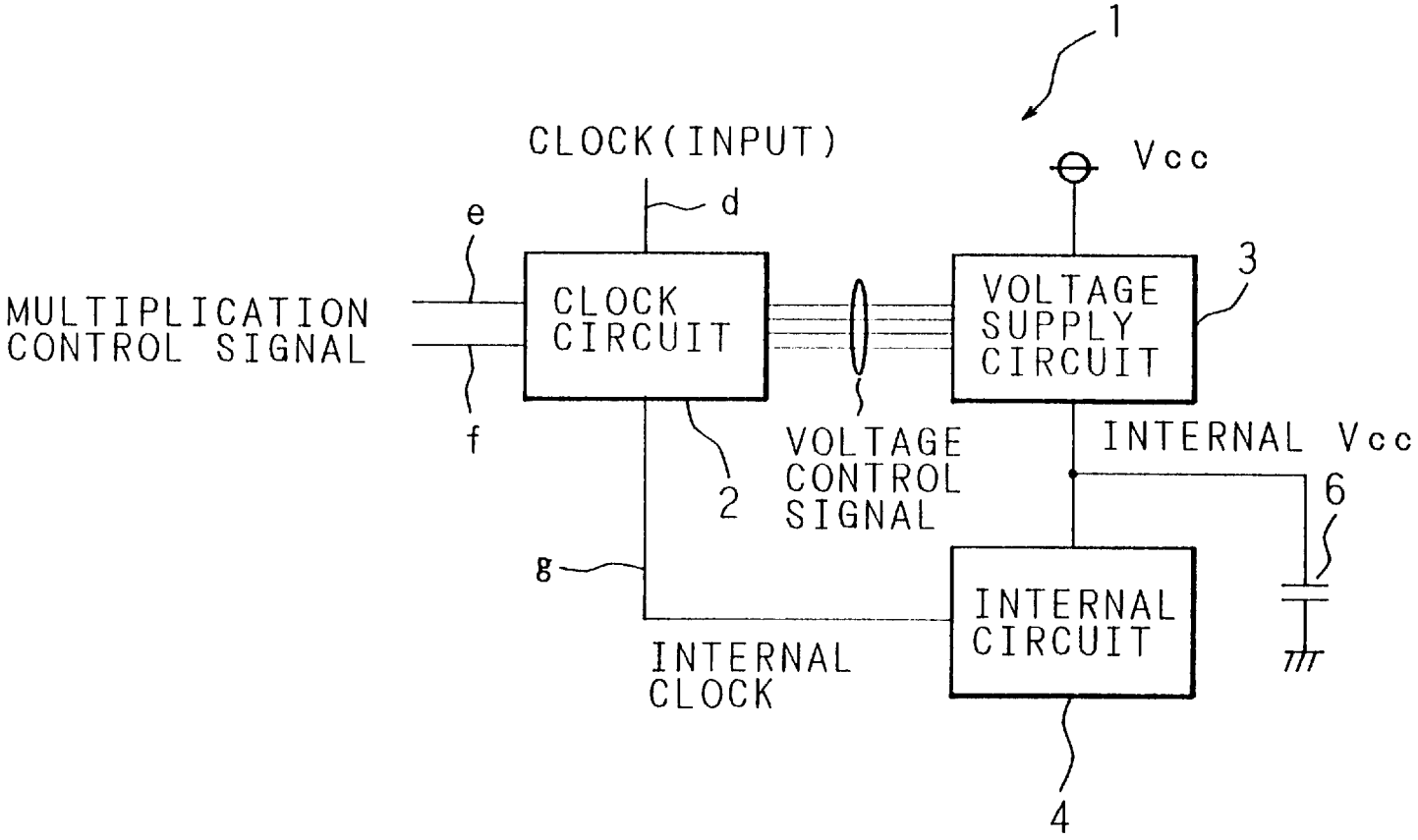
FIG. 1 is a block diagram showing an example of the structure of a semiconductor integrated circuit according to a first embodiment of the present invention.

FIG. 1 is a block diagram showing an example of the structure of a semiconductor integrated circuit according to a first embodiment of the present invention. A semiconductor integrated circuit 1 comprises an internal circuit 4 arranged to be operated in response to a clock, a voltage supply circuit 3 which controls voltage (Vcc) applied from an external power source to supply internal power-supply voltage (internal Vcc) to the internal circuit 4, and a clock circuit 2 for supplying an internal clock to the internal circuit 4 and for generating and transmitting a voltage control signal for causing the internal Vcc corresponding to the frequency of the internal clock to be supplied from the voltage supply circuit 3 to the internal circuit 4.

To the clock circuit 2, there are connected a signal line d to which a clock is supplied from outside and signal lines e and f through which a multiplication control signal for determining input and output ratio of the frequency of the clock is supplied to an included PLL (Phase Lock Loop) circuit from outside. The clock circuit 2 supplies the internal clock generated by the included PLL circuit in response to the clock supplied from the outside and the multiplication control signal to the internal circuit 4 through a signal line g.

The clock circuit 2 generates the voltage control signal for controlling switching of the power-supply voltage to internal Vcc to be supplied to the internal circuit 4, the voltage control signal being generated in response to the multiplication control signal and supplied to the voltage supply circuit 3. The voltage supply circuit 3 switches the supply path for Vcc in response to the voltage control signal so as to supply internal Vcc corresponding to the voltage control signal to the internal circuit 4. A grounded capacitor 6 is connected to internal Vcc output terminal of the voltage supply circuit 3.

Figure 2:
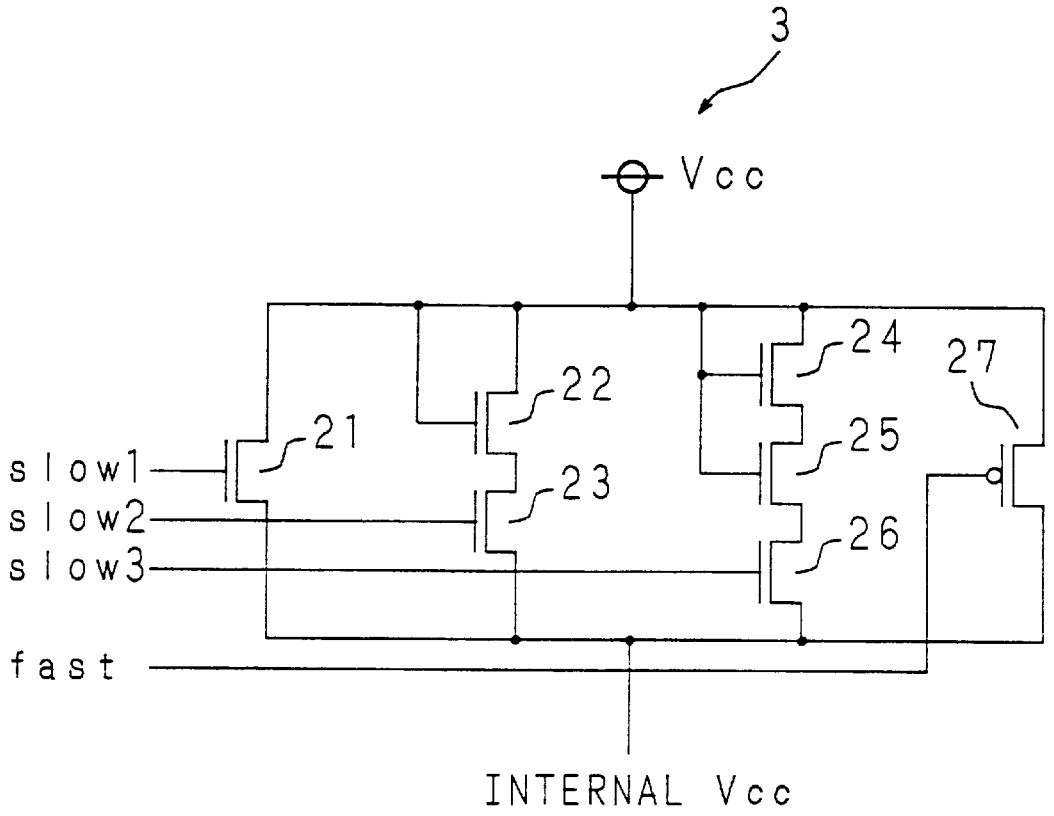
FIG. 2 is a circuit diagram showing an example of the structure of a voltage supply circuit.

FIG. 2 is a circuit diagram showing an example of the structure of the voltage supply circuit 3. The voltage supply circuit 3 has a structure such that an N channel transistor (hereinafter abbreviated as an "NchTr") 21, NchTr 22 and 23 connected in series, NchTr 24, 25 and 26 connected in series and a P channel transistor (hereinafter abbreviated as a "PchTr") 27 are connected in parallel between an external power-supply source and an output terminal for the internal Vcc. Each gate of the NchTr 22, 24 and 25 is applied with Vcc.

Voltage control signal fast, with which the highest internal Vcc is applied, is supplied to PchTr 27. The PchTr 27 is turned on when the voltage control signal fast is L (low) level. At this time, voltage obtained by subtracting the voltage corresponding to the voltage drop between the source and drain of the PchTr 27 from Vcc is transmitted from the output terminal of the internal Vcc.

Voltage control signal slow1, with which the secondly high internal Vcc is applied, is supplied to the NchTr 21. The NchTr 21 is turned on when the voltage control signal slow1 is H (high) level. At this time, voltage obtained by subtracting the voltage corresponding to the voltage drop between the source and drain of the NchTr 21 from Vcc is transmitted from the output terminal of the internal Vcc.

Voltage control signal slow2, with which the third high internal Vcc is applied, is supplied to the NchTr 23. The NchTr 23 is turned on when the voltage control signal slow2 is H (high) level. At this time, voltage obtained by subtracting the voltage corresponding to the voltage drop between the source and drain of the NchTr 22 and 23 from Vcc is transmitted from the output terminal of the internal Vcc.

Voltage control signal slow3, with which the lowest internal Vcc is applied, is supplied to the NchTr 26. The NchTr 26 is turned on when the voltage control signal slow3 is H (high) level. At this time, voltage obtained by subtracting the voltage corresponding to the voltage drop between the source and drain of the NchTr 24, 25 and 26 from Vcc is transmitted from the output terminal of the internal Vcc.

Figure 3:
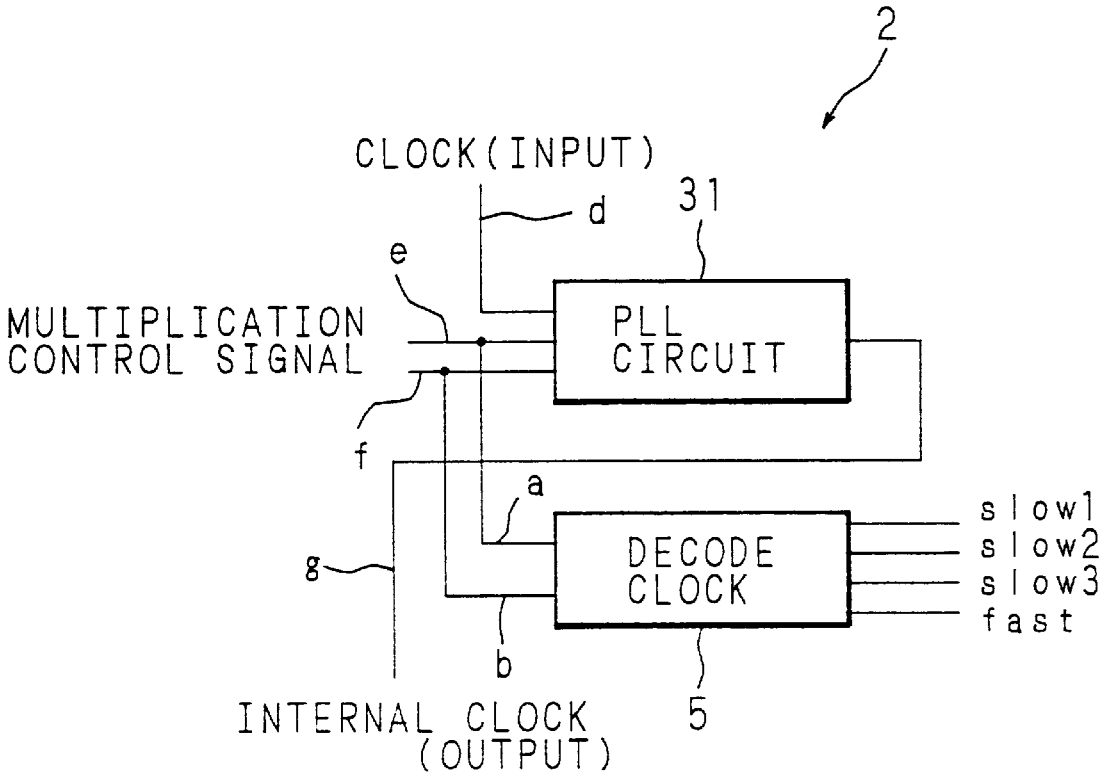
FIG. 3 is a block diagram showing an example of the structure of a clock circuit.

FIG. 3 is a block diagram showing an example of the structure of the clock circuit 2. Signal lines e and f through which the multiplication control signals are supplied from outside and a signal line d through which a clock is supplied from the outside are connected to the PLL circuit 31. The PLL circuit 31 divides the clocks supplied through the signal line d in accordance with the multiplication control signals supplied through the signal lines e and f in such a manner that the phases of the clocks are arranged so as to transmit the clocks as internal clocks to the signal line g.

Signal lines a and b respectively branched from the signal line e and f are connected to the decode circuit 5. The decode circuit 5 generates voltage control signals fast and slow1 to slow3 in response to the multiplication control signals supplied through the signal lines a and b to supply the same to the voltage supply circuit 3.

Figure 4:
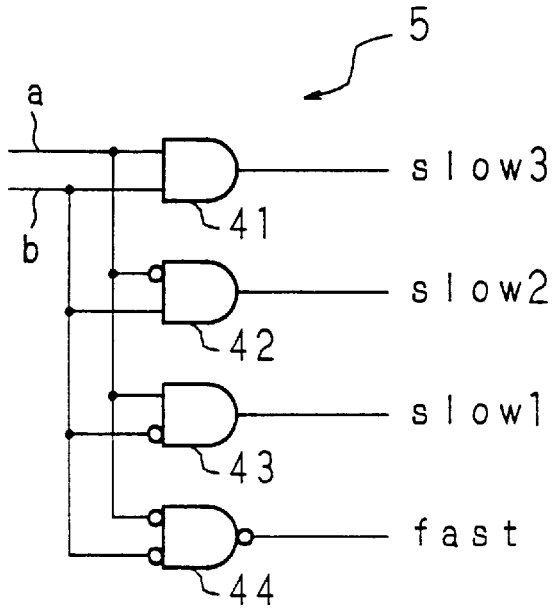
FIG. 4 is a block diagram showing an example of the structure of a decode circuit.

FIG. 4 is a block diagram showing an example of the structure of the decode circuit 5. The decode circuit 5 comprises an AND gate 41 having two inputs for receiving the multiplication control signals supplied through the signal lines a and b, an AND gate 42 having an input for receiving an inversion signal of the multiplication control signal supplied through the signal line a and another input for receiving the multiplication control signal supplied through the signal line b, an AND gate 43 having an input for receiving the multiplication control signal supplied through the signal line a and another input for receiving an inversion signal of the multiplication control signal supplied through the signal line b, and a NAND gate 44 having two inputs for receiving inversion signals of the multiplication control signals supplied through the signal lines a and b.

The AND gates 41, 42 and 43 and the NAND gate 44 respectively transmit voltage control signals slow3, slow2, slow1 and fast.

The decode circuit 5 is activated when the voltage control signal slow3 is high level in a case where the multiplication control signals supplied through the signal lines a and b are (1, 1). In a case where the multiplication control signals are (0, 1), it is activated when the voltage control signal slow2 is high level. In a case where the multiplication control signals are (1, 0), it is activated when the voltage control signal slow1 is high level. In a case where the multiplication control signals are (0, 0), it is activated when the voltage control signal fast is low level.

The operation of the semiconductor integrated circuit 1 having the foregoing structure will now be described.

Figure 12:
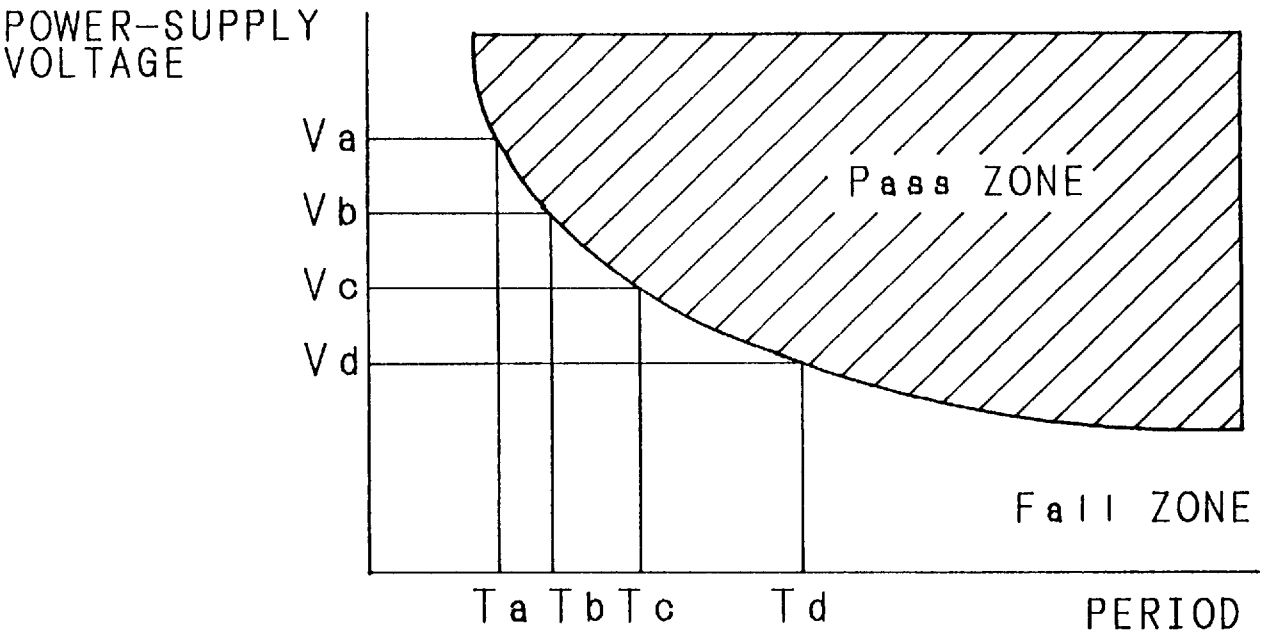
FIG. 12 is a graph showing power-supply voltage for each cycle of the clock at which an LSI can be operated.

FIG. 12 is a so-called Shmoo Plot graph showing the relationship between the cycles of the clock and the power-supply voltages at which the LSI can be operated. As a general rule, a semiconductor integrated circuit involves delay of the gate thereof being reduced as the operating voltage is high. That is, the longer the clock cycle is, the lower the operating power-supply voltage is sufficient. The shorter the clock cycle is, the higher operating voltage is needed.

The PLL circuit 31 of the clock circuit 2, in response to the multiplication control signals supplied through the signal lines e and f, divides clocks having frequencies within a predetermined range and supplied through the signal line d in such a manner that the phases of the clocks are arranged so as to transmit the clocks as internal clocks to the signal line g. This embodiment is able to switch the multiplication into four steps in response to the multiplication control signals. That is, in accordance with the sequential order of the multiplication control signals as (0, 0), (1, 0), (0, 1) and (1, 1), the cycle of the internal clock to be generated by the PLL circuit 31 is switched from short to long. The decode circuit 5 activates any one of the voltage control signals fast, slow1, slow2 and slow3 in accordance with the combination of the levels of the multiplication control signals.

When, for example, voltages Va, Vb, Vc and Vd shown in FIG. 12 respectively are intended to be supplied to the internal circuit 4 from the voltage supply circuit 3 as internal clocks Vcc in the case where the voltage control signals fast, slow1, slow2 and slow3 are activated, the shortest cycles of the internal clocks with which the semiconductor integrated circuit 1 can be operated are Ta, Tb, Tc and Td at the corresponding voltages Va, Vb, Vc and Vd.

Therefore, when the PLL circuit 31 generates internal clocks, the cycle T of which satisfies ranges $Ta<T\leqq Tb$, $Tb<T\leqq Tc$, $Tc<T\leqq Td$ and $Td<T$ to correspond to the multiplication control signals (0, 0), (1, 0), (0, 1) and (1, 1) of the PLL circuit 31, the internal clocks are made to be Va, Vb, Vc and Vd.

As described above, the semiconductor integrated circuit 1 according to this embodiment generates the voltage control signals in accordance with the multiplications of the PLL circuit 31 and controls the internal Vcc in response to the voltage control signals. Therefore, the semiconductor integrated circuit 1 can be operated at optimum voltage corresponding to the operating frequency.

[Embodiment 2]

Figure 5:
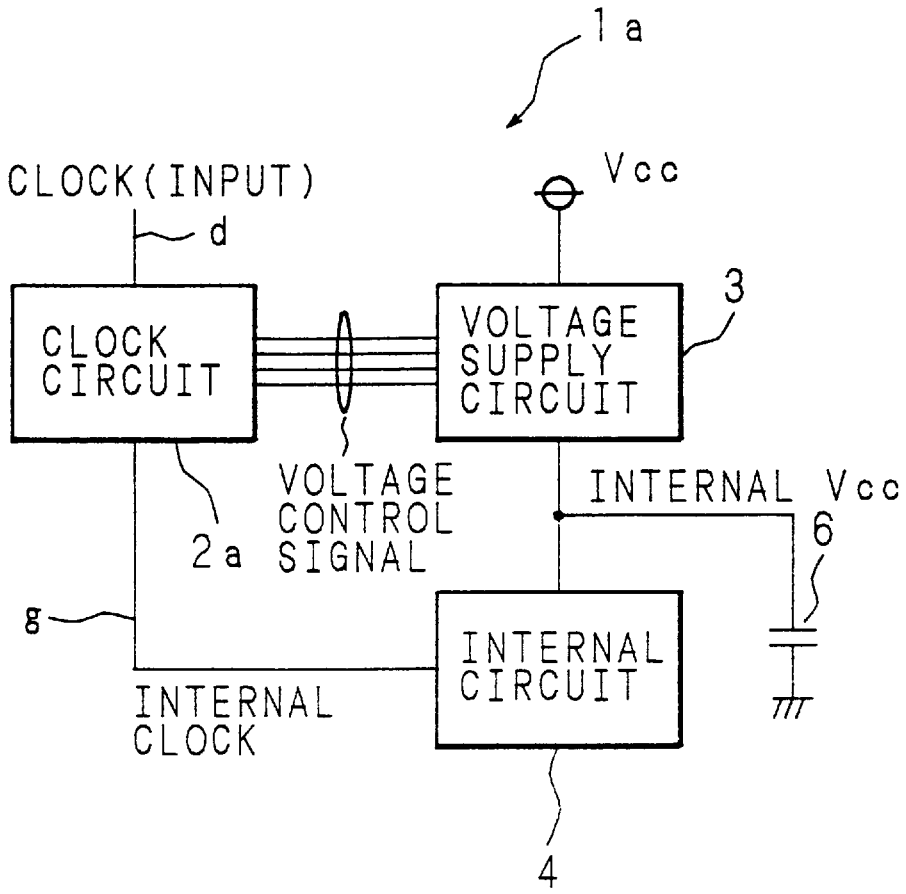
FIG. 5 is a block diagram showing an example of the structure of a semiconductor integrated circuit according to a second embodiment of the present invention.

FIG. 5 is a block diagram showing an example of the structure of a semiconductor integrated circuit according to a second embodiment of the present invention. A semiconductor integrated circuit la comprises an internal circuit 4 which is operated in response to a clock, a voltage supply circuit 3 which controls voltage Vcc supplied from an external power source to supply internal Vcc to the internal circuit 4, and a clock circuit 2*a* for supplying an internal clock to the internal circuit 4 and generating and transmitting a voltage control signal for causing internal Vcc corresponding to the frequency of the internal clock to be supplied from the voltage supply circuit 3 to the internal circuit 4.

A signal line d to which a clock is supplied from outside is connected to the clock circuit 2*a*. The clock circuit 2*a* supplies the internal clock formed by shaping the waveform of the clock supplied from the outside to the internal circuit 4 through a signal line g.

The clock circuit 2*a* supplies, to the voltage supply circuit 3, the voltage control signal for controlling switching of the power-supply voltage to internal Vcc to be supplied to the internal circuit 4. The voltage supply circuit 3 switches the supply path for Vcc in response to the voltage control signal so as to supply internal Vcc corresponding to the voltage control signal to the internal circuit 4. A capacitor 6 having a grounded terminal is connected to internal Vcc output terminal of the voltage supply circuit 3.

Figure 6:
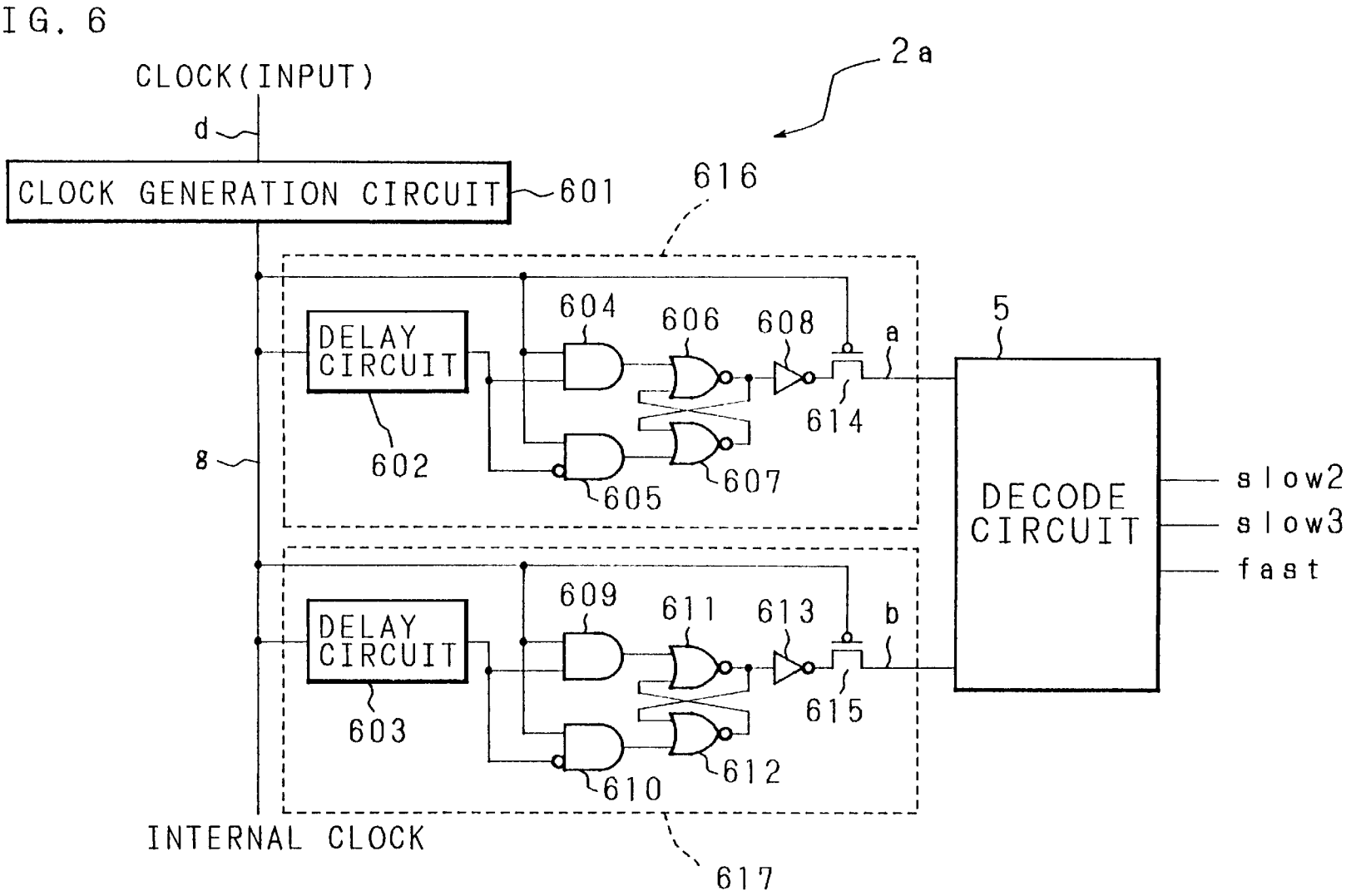
FIG. 6 is a block diagram showing an example of the structure of a clock circuit.

FIG. 6 is a block diagram showing an example of the structure of the clock circuit 2*a*. A signal line d to which a clock is supplied from outside is connected to a clock generation circuit 601. The clock generation circuit 601 shapes the waveform of the clock supplied from the outside to generate the internal clock. The internal clock is supplied to the internal circuit 4 through the signal line g and also supplied to delay circuits 602 and 603 having corresponding delay times Td1 and Td2.

The internal clock delayed by the delay circuit 602 is supplied to an input terminal of an AND gate 604 having another input terminal to which the internal clock is supplied. An inversion signal of the internal clock delayed by the delay circuit 602 is supplied to an input terminal of an AND gate 605 having another input terminal to which the internal clock is supplied.

Each of outputs from the AND gates 604 and 605 is supplied to one of input terminals of each of NOR gates 606 and 607. Outputs from the NOR gates 606 and 607 are supplied to other input terminals of the NOR gates 607 and 606. The NOR gates 606 and 607 constitute an RS flip flop. An output from the NOR gate 606 is supplied to the source of a PchTr 614 through an inverter 608. The drain of the PchTr 614 is, through a signal line a, connected to a decode circuit 5, while the gate of the PchTr 614 is supplied with the internal clock.

The internal clock delayed by the delay circuit 603 is supplied to an input terminal of an AND gate 609 having another input terminal to which the internal clock is supplied. An inversion signal of the internal clock delayed by the delay circuit 603 is supplied to an input terminal of an AND gate 610 having another input terminal to which the internal clock is supplied.

Each of outputs from the AND gates 609 and 610 is supplied to either input terminal of each of the NOR gates 611 and 612. Outputs from the NOR gates 611 and 612 are supplied to other input terminals of the NOR gates 612 and 611. The NOR gates 611 and 612 constitute an RS flip flop. An output from the NOR gate 611 is supplied to the source of a PchTr 615 through the inverter 613. The drain of the PchTr 615 is connected to the decode circuit 5 through the signal line b. The gate of the PchTr 615 is supplied with the internal clock.

A circuit from the delay circuit 602 to the signal line a and that from the delay circuit 603 to the signal line b respectively form cycle judgement circuits 616 and 617. Since the other structures of the semiconductor integrated circuit la are similar to the structures of the semiconductor integrated circuit 1 according to the first embodiment, description of the similar portions are omitted here.

The operation of the semiconductor integrated circuit 1*a* having the foregoing structure will now be described.

In the clock circuit 2*a*, the cycle judgment circuits 616 and 617 composed of the delay circuits 602 and 603 and the like detect cycle T of the internal clock so as to cause the decode circuit 5 to transmit voltage control signals slow1 to slow3 and fast corresponding to the cycle of the internal clock.

If delay time Td1 of the delay circuit 602 is T≧2Td1 (where the duty ratio of the internal clock is 50%) and the cycle of the internal clock is relatively long, the output from the delay circuit 602 is changed from "0" to "1" when the internal clock is "1". Therefore, the output from the AND gate 604 is changed from "0" to "1" and the output from the AND gate 605 is changed from "1" to "0" so that the RS flip flop is set. As a result, the output from the NOR gate 606 is maintained at "0" and output "1" from the delay circuit 602 is held at the output from the inverter 608.

If the internal clock has been made to be "0" in the foregoing state, the output from the AND gate 604 is changed from "1" to "0" and the output from the AND gate 605 is maintained at "0". Therefore, the RS flip flop maintains the previous state. Thus, in a state where the output "0" from the NOR gate 606 is maintained, that is, the output "1" from the inverter 608 is maintained, the PchTr 614 is turned on so that "1" is transmitted to the signal line a.

In a case where delay time Td1 of the delay circuit 602 satisfies T<2Td1 and, therefore, the cycle of the internal clock is relatively short, the output from the delay circuit 602 is changed to "0" when the internal clock is "1". Therefore, the output from the AND gate 604 is changed from "1" to "0" and the output from the AND gate 605 is changed from "0" to "1" so that the RS flip flop is reset. As a result, the output from the NOR gate 606 is maintained at "1" so that output "0" from the delay circuit 602 is held at the output from the inverter 608.

When the internal clock is made to be "0" in the foregoing state, the output "0" from the AND gate 604 is maintained and the output from the AND gate 605 is changed from "1" to "0". Therefore, the RS flip flop maintains the previous state. Thus, in a state where the output from the NOR gate 606 is maintained at "1", that is, the output from the inverter 608 is maintained at "0", the PchTr 614 is turned on so that "0" is transmitted to the signal line a.

The operation of the cycle judgment circuit 616 is similar to that of the cycle judgment circuit 617. Therefore, if delay time Td2 of the delay circuit 603 is T≧2Td2, output to the signal line b is "1". If T<2Td2, output to the signal line b is "0". Note that T>Td1, Td2.

Assuming that Td1<Td2, signals on the signal lines a and b connected to the decode circuit 5 are (0, 0) when T<2Td1. When 2Td2>T≧2Td1, the signals are (1, 0). When T≧2Td2, the signals are (1, 1). In the case where two cycle judgment circuits are provided, only three combinations are generated. Therefore, the circuit according to this embodiment does not generate combination (0, 1). If one cycle judgment circuit is added, four combinations can be generated.

The levels of the signals of the signal lines a and b are maintained at substantially constant regardless of whether the PchTr 614 and 615 are turned on or off because the change of the low level and high level of the clock is performed at high speed as the time elapses.

In the decode circuit 5, any of the voltage control signals fast, slow2 and slow3 is activated in accordance with whether the internal clock is slow or fast (whether or not the clock cycle is long or short) so as to be supplied to the voltage supply circuit 3.

In this embodiment, assuming that Tc=2Td1 and Td=2Td2 shown in FIG. 12, voltage of the internal Vcc must be Va, Vc and Vd in respective ranges T<Tc, Td>T≧Tc and T≧Td (where Va>Vc>Vd). Since the other operations of the semiconductor integrated circuit la are similar to those of the semiconductor integrated circuit 1 according to the first embodiment, it is omitted from description.

[Embodiment 3]

Figure 7:
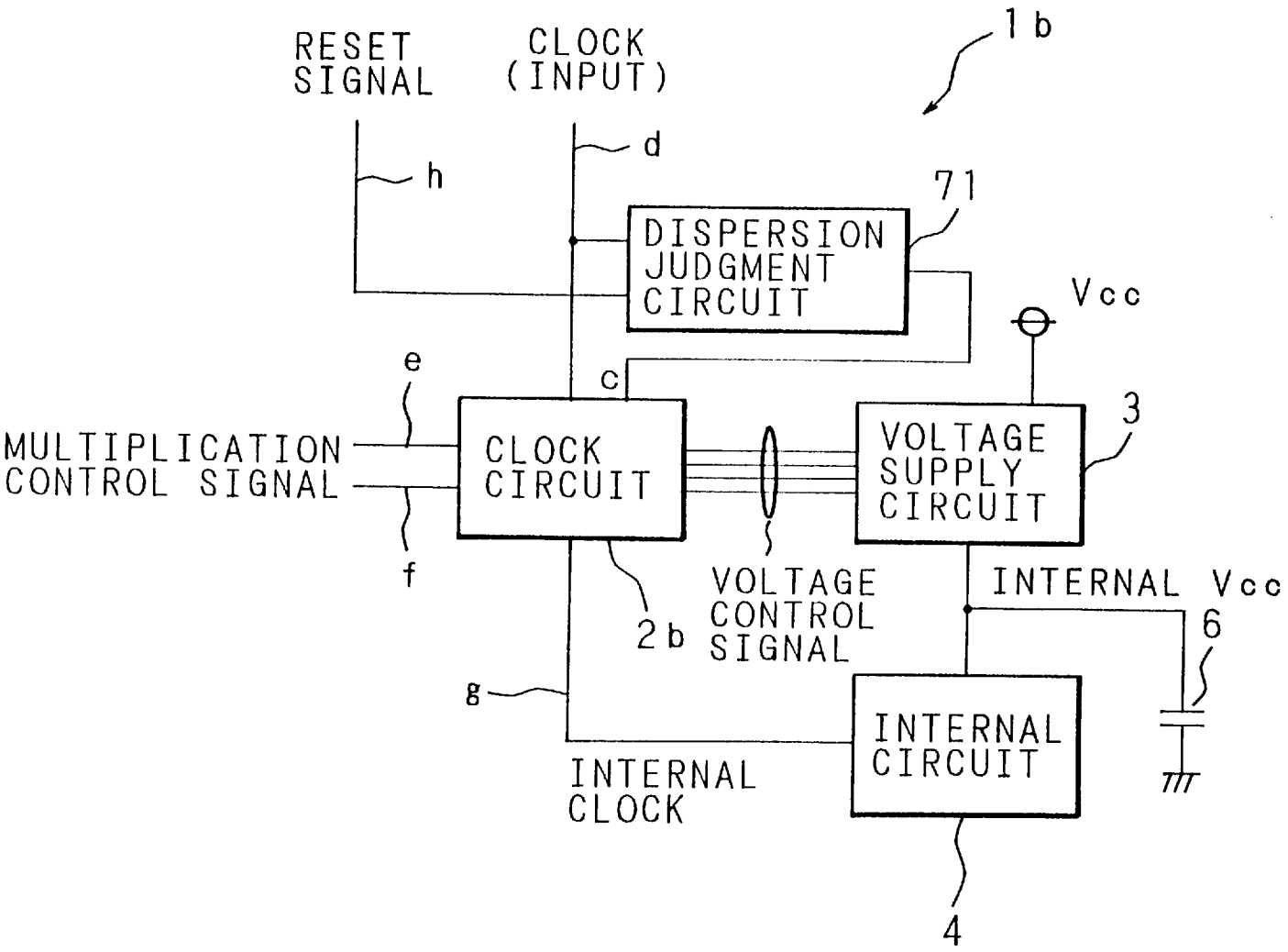
FIG. 7 is a block diagram showing an example of the structure of a semiconductor integrated circuit according to a third embodiment of the present invention.

FIG. 7 is a block diagram showing an example of the structure of a semiconductor integrated circuit according to a third embodiment of the present invention. A semiconductor integrated circuit 1*b* comprises an internal circuit 4 which is operated in response to a clock, a voltage supply circuit 3 which controls voltage (Vcc) applied from an external power source to supply internal power-supply voltage (internal Vcc) to the internal circuit 4, and a clock circuit 2*b* for supplying internal clock to the internal circuit 4 and generating and transmitting a voltage control signal with which internal Vcc corresponding to the frequency of the internal clock is supplied from the voltage supply circuit 3 to the internal circuit 4.

To the clock circuit 2*b*, there are connected a signal line d to which a clock is supplied from outside, signal lines e and f through which multiplication control signals for determining input/output ratio of the clock frequency are supplied from outside to an included PLL circuit, and a signal line c to which dispersion control signal indicating dispersion of the signal transmission speed of the semiconductor integrated circuit 1*b* from standard speed is supplied from a dispersion judgment circuit 71 for judging the signal transmission speed of the semiconductor integrated circuit 1*b*. The clock circuit 2*b* supplies, to the internal circuit 4 through the signal line g, the internal clock generated by the PLL circuit in response to the clock and the multiplication control signal supplied from outside.

The clock circuit 2*b*, in response to the multiplication control signal and the dispersion control signal, generates a voltage control signal for controlling switching of the power-supply voltage to internal Vcc to be supplied to the internal circuit 4, the voltage control signal being supplied to the voltage supply circuit 3. The voltage supply circuit 3 switches the supply path for Vcc in response to the voltage control signal and supplies internal Vcc corresponding to the voltage control signal to the internal circuit 4. A capacitor 6 having a grounded terminal is connected to the output terminal of the voltage supply circuit 3 for the internal Vcc.

To the dispersion judgment circuit 71, there are connected a reset signal line h to which a reset signal for the semiconductor integrated circuit 1*b* is supplied from outside and a signal line d to which the clock is supplied from outside. The dispersion judgment circuit 71 judges the signal transmission speed of the semiconductor integrated circuit 1*b* from the reset signal and the clock supplied from the outside to supply a dispersion control signal indicating degree of slow or fast of the signal transmission speed, that is, dispersion from a standard, to the clock circuit 2*b* through the signal line c.

Figure 8:
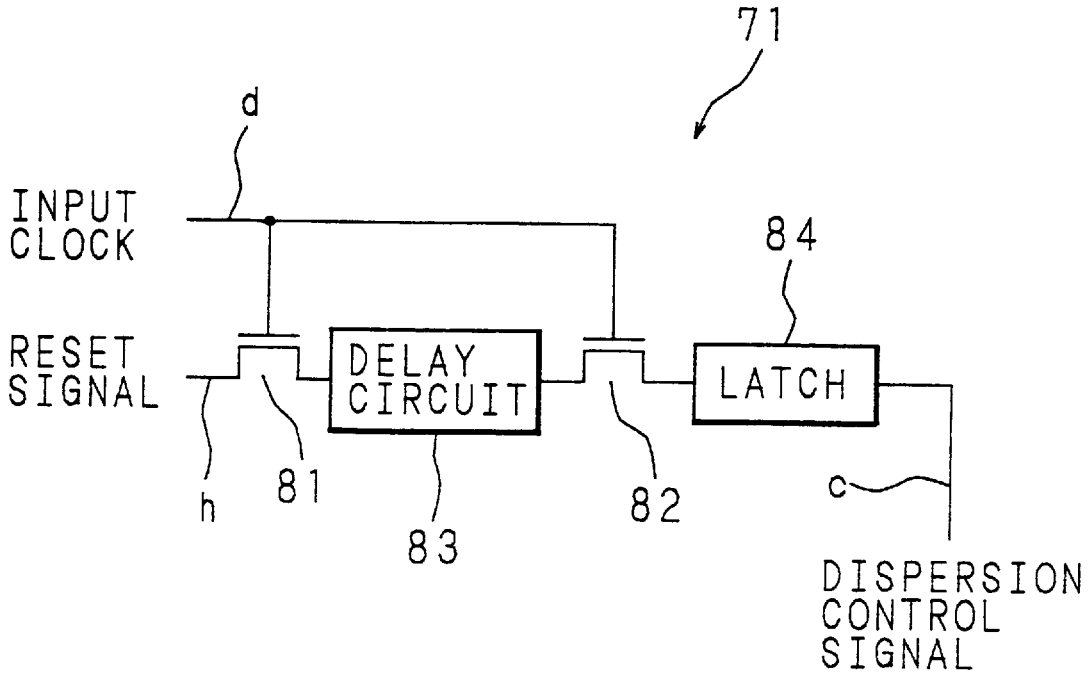
FIG. 8 is a block diagram showing an example of the structure of a dispersion judgment circuit.

FIG. 8 is a block diagram showing an example of the structure of the dispersion judgment circuit 71. In the dispersion judgment circuit 71, a reset signal line h is connected to the drain of an NchTr 81 having a gate to which a signal line d, to which a clock is supplied from outside, is connected. The source of the NchTr 81 is connected to an input terminal of a delay circuit 83 formed by sequentially connecting a plurality of logical gates. An output terminal of the delay circuit 83 is connected to the drain of an NchTr 82 having a gate to which the signal line d is connected. The source of the NchTr 82 is connected to an input terminal of the latch circuit 84. An output terminal of the latch circuit 84 is connected to a signal line c for supplying the dispersion control signal to the clock circuit 2*b*.

Figure 9:
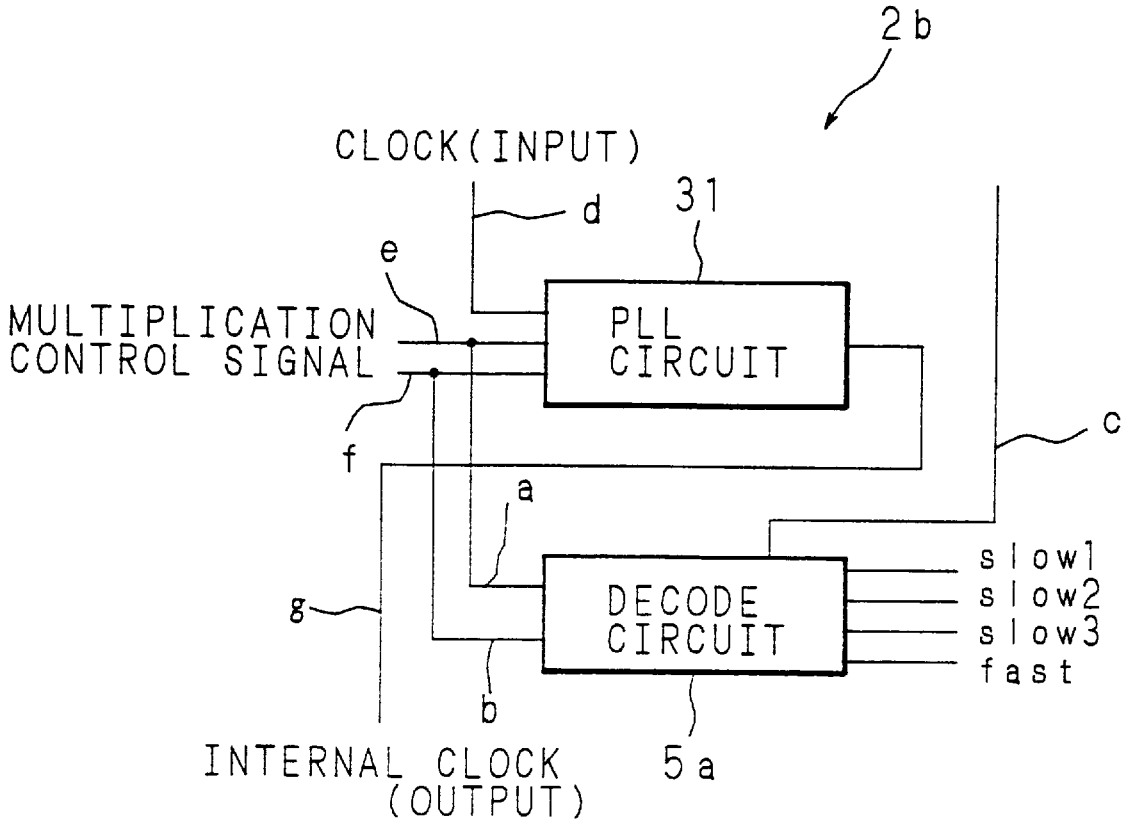
FIG. 9 is a block diagram showing an example of the structure of a clock circuit.

FIG. 9 is a block diagram showing an example of the structure of the clock circuit 2*b*. To the PLL circuit 31, there are connected signal lines e and f to which the multiplication control signals are supplied from outside and a signal line d to which the clock is supplied from the outside. The PLL circuit 31 divides the clocks supplied through the signal line d in response to the multiplication control signals supplied through the signal lines e and f in such a manner that the phases of the clocks are arranged, the clocks being then transmitted to the signal line g as internal clocks.

Signal lines a and b branched from the signal lines e and f and signal line c to which the dispersion control signal is supplied are connected to the decode circuit 5*a*. The decode circuit 5*a* generates voltage control signals fast and slow1 to slow3 in response to the multiplication control signals and the dispersion control signal supplied through the signal lines a and b.

Figure 10:
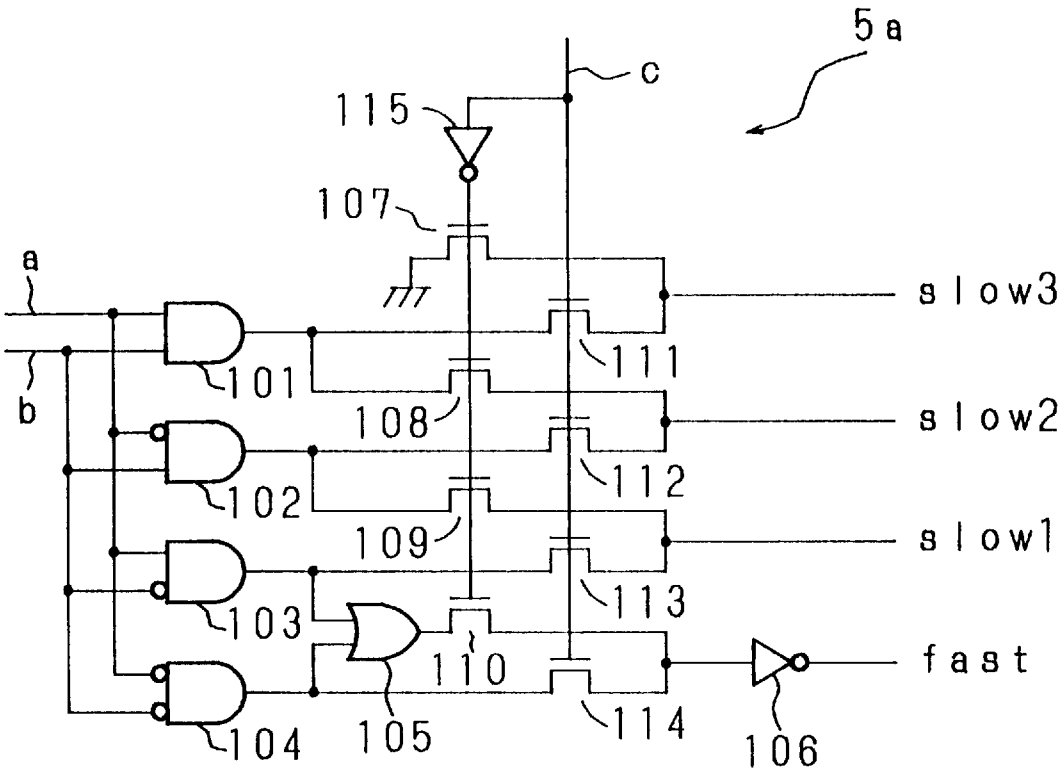
FIG. 10 is a block diagram showing an example of the structure of a decode circuit.

FIG. 10 is a block diagram showing an example of the structure of the decode circuit 5*a*. The decode circuit 5*a* comprises an AND gate 101 having two inputs for receiving the multiplication control signals supplied through the signal lines a and b, an AND gate 102 having an input for receiving an inversion signal of the multiplication control signal supplied through the signal line a and another input for receiving the multiplication control signal supplied through the signal line b, an AND gate 103 having an input for receiving the multiplication control signal supplied through the signal line a and another input for receiving an inversion signal of the multiplication control signal supplied through the signal line b, and a negative-logic NOR gate 104 having two inputs for receiving the multiplication control signals supplied through the signal lines a and b.

An output terminal of the AND gate 101 is connected to the drain of an NchTr 111. The source of the NchTr 111 is connected to the drain of an NchTr 107 having a grounded source so as to transmit the voltage control signal slow3.

An output terminal of the AND gate 102 is connected to the drain of the NchTr 112. The source of the NchTr 112 is connected to the source of the NchTr 108 having a drain connected to the output terminal of the AND gate 101 so as to transmit voltage control signal slow2.

An output terminal of the AND gate 103 is connected to the drain of the NchTr 113. The source of the NchTr 113 is connected to the source of the NchTr 109 having a drain connected to the output terminal of the AND gate 102 so as to transmit voltage control signal slow1.

An output terminal of the NOR gate 104 is connected to the drain of the NchTr 114. The source of the NchTr 114 is connected to the source of the NchTr 110 and an input terminal of the inverter 106. The inverter 106 transmits voltage control signal fast. The drain of the NchTr 110 is connected to an output terminal of an OR gate 105 having two inputs for receiving the outputs of the AND gates 103 and 104.

The signal line c is connected to each gate of the NchTr 111 to 114. An output terminal of the inverter 115 for inverting the dispersion control signal supplied through the signal line c is connected to each gate of the NchTr 107 to 110. Since the other structures of the semiconductor integrated circuit 1*b* are similar to those of the semiconductor integrated circuit 1 according to the first embodiment, they are omitted from description.

The operation of the semiconductor integrated circuit 1*b* having the foregoing structure will now be described.

Semiconductor integrated circuits encounter individual differences due to dispersion in manufacturing even if they are operated with the same power-supply voltage and at the same temperature, thus resulting in dispersion in the operation speed. The semiconductor integrated circuit 1*b* controls the internal power-supply voltage in consideration of the dispersion in the operation speed taking place due to the dispersion in manufacturing.

When the semiconductor integrated circuit 1*b* has been reset, the dispersion judgment circuit 71 judges whether the operation speed is high or low, that is, dispersion of the operation speed from a standard. In the dispersion judgment circuit 71, the NchTr 81 is turned on when a clock supplied from outside through the signal line d is enabled in a state where reset signal "1" has been supplied so that the reset signal "1" is supplied to a delay circuit 83.

As described above, when the clock supplied from outside has been enabled, also the NchTr 81 is turned on. If the delay time of the delay circuit 83 is shorter than the enable time for the clock, the reset signal "1" is transmitted to the latch circuit 84 and held in the same during a period in which the NchTr 82 is turned on. At this time, the dispersion control signal is made to be "1" and thus a determination is performed that the dispersion in the speed is standard.

If the delay time of the delay circuit 83 is longer than the enable time for the clock, the reset signal "1" is not transmitted to the latch circuit 84 during the time in which the NchTr 82 is turned on. Thus, the signal held in the latch circuit 84 is made to be "0". At this time, the dispersion control signal is made to be "0" and thus a determination is performed that the dispersion in the speed is somewhat slow.

As a result, during the reset period for the semiconductor integrated circuit 1*b*, the dispersion judgment circuit 71 judges dispersion of the operation speed of the semiconductor integrated circuit 1*b* from the standard by using the enable time of the clock from the outside as a standard.

When the dispersion control signal supplied through the signal line c is "1", that is, when the dispersion in the speed is standard, the decode circuit 5*a* is operated similar to the decode circuit 5 (see FIG. 4) according to the first embodiment. If the dispersion control signal is "0", the decode circuit 5*a* shifts the voltage control signals fast, slow1, slow2 and slow3 to voltage control signals fast, fast, slow1 and slow2 with which higher internal Vcc is applied.

That is, when the dispersion control signal is "1", the voltage of the internal Vcc corresponding to the case where the cycle T of the internal clock is $Ta<T\leqq Tb$, $Tb<T\leqq Tc$, $Tc<T\leqq Td$, $Td<T$ ($Ta<Tb<Tc<Td$) are Va, Vb, Vc, Vd ($Va>Vb>Vc>Vd$). When the dispersion control signal is "0", the internal Vcc are Va, Va, Vb and Vc.

As a result, a semiconductor integrated circuit involving excess dispersion in the speed and somewhat slow signal transmission speed is operated with internal Vcc higher than the internal Vcc on the basis of the multiplication control signal so that the operation speed is made to be near the standard speed.

Although the foregoing embodiment judges the dispersion by using the reset signal, another signal may be used to perform similar judgment. However, it is preferable that the control of the judgment of the internal Vcc be performed during reset period at the start of the operation of the semiconductor integrated circuit. Since the other operations of the semiconductor integrated circuit 1*b* are similar to those of the semiconductor integrated circuit 1 according to the first embodiment, they are omitted from illustration.

[Embodiment 4]

Figure 11:
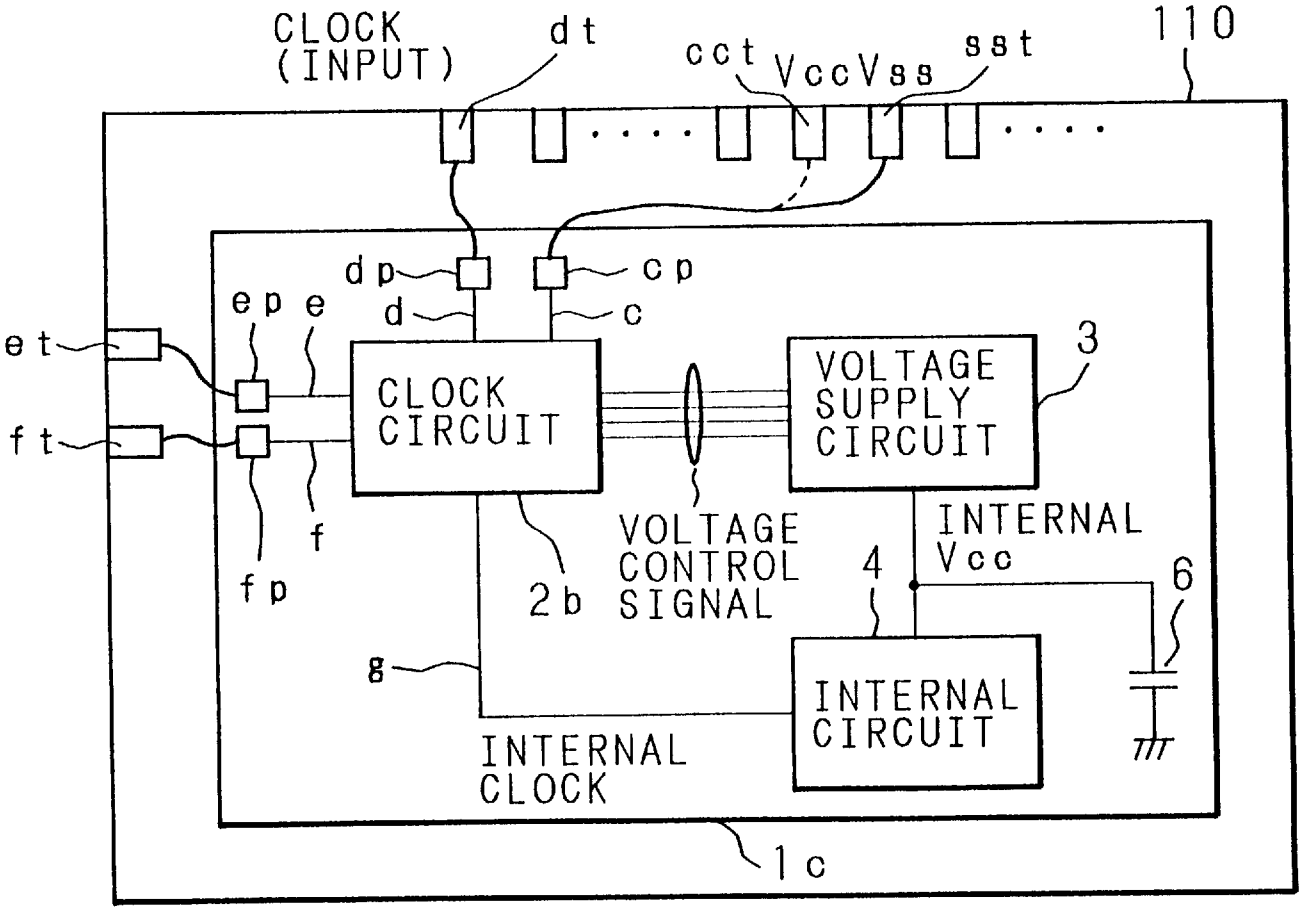
FIG. 11 is a block diagram showing an example of the structure of a semiconductor integrated circuit device according to the present invention.

FIG. 11 is a block diagram showing an example of a semiconductor integrated circuit according to the present invention. A semiconductor integrated circuit device 110 is provided with terminal group. (dt, cct, sst, et, ft, . . . ) in the periphery thereof. The terminals of the terminal group respectively are wire-bonded to pads (dp, cp, ep and fp) in the semiconductor integrated circuit 1*c*. The terminals et and ft to which the multiplication control signals of the PLL circuit are supplied from outside are wire-bonded to the pads ep and fp to which signal lines e and f respectively are connected. The terminal dt to which a clock is supplied from outside is wire-bonded to the pad dp to which the signal line d is connected.

The Vcc terminal cct or Vss terminal sst to which dispersion control signal "1" or "0" is supplied from outside is bonded to the pad cp to which a dispersion control signal line c is connected. The other structures of the semiconductor integrated circuit 1*c* are similar to those of the semiconductor integrated circuit 1*b* according to the third embodiment, they are omitted from description (note that the semiconductor integrated circuit 1*c* according to this embodiment has not the dispersion judgment circuit 71).

The semiconductor integrated circuit 110 having the foregoing structure has the arrangement such that the dispersion control signal is fixed to "1" or "0" by wire bonding when accommodated in a package in place of generating the dispersion control signal by the dispersion judgment circuit 71 of the semiconductor integrated circuit 1*b* according to the third embodiment.

That is, when wire bonding is performed which is an assembly process for mounting the chip of the semiconductor integrated circuit 1*c* on a package, the pad cp to which the dispersion control signal line c is connected is connected to the Vcc terminal cct or the Vss terminal sst.

Whether the pad cp is connected to the Vcc terminal cct or the Vss terminal sst is determined such that a test is performed in a wafer state in which the chip of the semiconductor integrated circuit 1*c* has not been diced to evaluate the dispersion in the speed. As a result, the conditions under which the semiconductor integrated circuit 1*c* can reliably be operated can be programmed by wire bonding. Since the other operations of the semiconductor integrated circuit 1*c* are similar to those of the semiconductor integrated circuit 1*b* according to the third embodiment, they are omitted from illustration.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A semiconductor integrated circuit comprising:

a circuit for generating an internal clock for operating an internal circuit from an externally supplied clock, wherein said internal clock generation circuit changes the frequency of the externally supplied clock with a multiplication factor corresponding to an externally supplied multiplication control signal to generate said internal clock for operating said internal circuit;

a circuit for generating a voltage control signal for controlling conversion of an externally supplied power-supply voltage into an internal voltage at which said internal circuit can operate on the frequency of said internal clock; and a circuit for supplying said internal voltage to said internal circuit by converting the externally supplied power-supply voltage into said internal voltage responsive to said voltage control signal.

2. A semiconductor integrated circuit comprising:

a circuit for dividing a frequency of an externally supplied clock supplied from outside to generate an internal clock for operating an internal circuit;

a circuit having a delay circuit for delaying said internal clock by a predetermined time which enables the cycle of the internal clock to be judged, for judging the cycle of said internal clock in accordance with a result of a comparison between the time delayed by said delay circuit and the cycle of said internal clock;

a circuit for generating a voltage control signal for converting an externally supplied power-supply voltage into an internal voltage at which said internal circuit can operate on the frequency of said internal clock in accordance with a result of judgment performed by said judgment circuit; and a circuit for supplying said internal voltage to said internal circuit by converting the power-supply voltage into said internal voltage responsive to said voltage control signal.

3. A semiconductor integrated circuit comprising:

a circuit for changing a frequency of an externally supplied clock supplied from outside to generate an internal clock for operating an internal circuit;

a plurality of judgment circuits which respectively have delay circuits of different delay times circuits for delaying said internal clock by predetermined times which enables the cycle of the internal clock to be judged, for judging the cycle of said internal clock in accordance with a result of a comparison between the time delayed by said delay circuits and the cycle of said internal clock;

a circuit for generating a voltage control signal for converting an externally supplied power-supply voltage into an internal voltage at which said internal circuit can operate on the frequency of said internal clock in accordance with a result of judgment performed by said judgment circuit; and a circuit for supplying said internal voltage to said internal circuit by converting the power-supply voltage into said internal voltage responsive to said voltage control signal, wherein plurality of judgment circuits are provided which respectively have delay circuits of said voltage control signal generation circuit is a circuit for transmitting said voltage control signal in accordance with a combination of respective results of the judgment performed by said plural judgment circuits.

4. A semiconductor integrated circuit comprising:

a circuit for generating an internal clock for operating an internal circuit from an externally supplied clock;

a circuit for generating a voltage control signal for converting an externally supplied power-supply voltage into an internal voltage at which said internal circuit can operate on the frequency of said internal clock;

a circuit for said internal supplying voltage to said internal circuit by converting the externally supplied power-supply voltage into said internal voltage responsive to said voltage control signal; and a dispersion signal generation circuit having a circuit for delaying an externally supplied predetermined signal by a time relating to a predetermined cycle of the internal clock and a circuit for holding an output from said delay circuit, so as to generate a dispersion control signal corresponding to the degree of dispersion of a signal transmission speed by said generated internal clock from a signal transmission speed by the internal clock having said predetermined cycle according to whether said predetermined signal is held by said holding circuit when said predetermined signal is delayed by said delay circuit with said generated internal clock, and said voltage control signal generation circuit is a circuit for generating said voltage control signal corresponding to said dispersion control signal.

5. A semiconductor integrated circuit according to claim 4 wherein said predetermined signal is a reset signal, and said voltage control signal generation circuit is a circuit for generating said voltage control signal corresponding to said dispersion control signal generated from said reset signal.

6. A semiconductor integrated circuit device with a semiconductor integrated circuit mounted, which has a plurality of terminals wire-bonded to input and output pads of said semiconductor integrated circuit, said semiconductor integrated circuit comprising:

a circuit for generating an internal clock for operating an internal circuit from an externally supplied clock;

a circuit for generating a voltage control signal for converting an externally supplied power-supply voltage into an internal voltage at which said internal circuit can operate on the frequency of said internal clock;

a circuit for supplying said internal voltage to said internal circuit by converting the power-supply voltage into said internal voltage responsive to said voltage control signal;

a dispersion judgment circuit for judging a signal transmission speed of the semiconductor integrated circuit, wherein said plurality of terminals includes a terminal to which signal voltage is applied to said dispersion judgment circuit which corresponds to the degree of dispersion of signal transmission speed by said internal clock generated by said internal clock generation circuit from signal transmission speed by the internal clock having a predetermined cycle, and said voltage control signal generation circuit generates said voltage control signal according to said signal voltage.

* * * * *